United States Patent [19]

Takagi et al.

[11] 4,385,108

[45] May 24, 1983

[54] METHOD OF FORMING NEGATIVE DOT IMAGES

[75] Inventors: Yoshihiro Takagi; Yoshitaka Akimura; Hiroyuki Mifune; Eiichi Okutsu, all of Minami-ashigara, Japan

[73] Assignee: Fuji Photo Film Co., Ltd., Minami-ashigara, Japan

[21] Appl. No.: 162,350

[22] Filed: Jun. 23, 1980

[30] Foreign Application Priority Data

Jun. 21, 1979 [JP] Japan ..... 54-78338
Jul. 6, 1979 [JP] Japan ..... 54-85660

[51] Int. Cl.[3] ..... G03C 5/30; G03C 1/06

[52] U.S. Cl. ..... 430/264; 430/405; 430/487; 430/438; 430/599; 430/441; 430/602; 430/448

[58] Field of Search ..... 430/264, 405, 265, 448, 430/438, 441, 487, 599, 602

[56] References Cited

U.S. PATENT DOCUMENTS 3,847,618 11/1974 Hofman ..... 430/405
4,168,977 9/1979 Takada et al. ..... 430/448
4,221,857 9/1980 Okutsu et al. ..... 430/448
4,224,401 9/1980 Takada et al. ..... 430/437
4,243,739 1/1981 Mitune et al. ..... 430/266

*Primary Examiner*—John E. Kittle
*Assistant Examiner*—John L. Goodrow
*Attorney, Agent, or Firm*—Sughrue, Mion, Zinn, Macpeak and Seas

[57] ABSTRACT

A method of forming negative dot images which comprises imagewise exposing through a contact screen a silver halide photographilic light-sensitive material of substantially the surface latent image type containing in a silver halide emulsion layer or another hydrophilic colloidal layer (a) a hydroquinone developing agent, and (b) a compound represented by the formula, $R^1NHNHCOR_2$, wherein $R^1$ is an aryl group which may be substituted, and $R^2$ is a hydrogen atom, an alkyl group which may be substituted, or an aryl group which may be substituted, and thereafter processing the thus exposed light-sensitive material with an activator aqueous solution having a pH of 11.5 or more.

16 Claims, No Drawings

METHOD OF FORMING NEGATIVE DOT IMAGES

BACKGROUND OF THE INVENTION

1. Field of the Invention

This invention relates to a negative dot image-forming method using a silver halide photographic light-sensitive material and more particularly to a stable activator type developing method which permits a dot image of good dot quality and screen range to be formed by use of a hydrazine compound.

2. Description of the Prior Art

In printing an original of continuous gradation by use of an off-set plate or the like, the tone is reproduced by a collection of big and small points called "dots". These dots are very minute and are present in a number of 80 to 200 per square inch, and moreover they are required to be sharp individually. In the printing industry, therefore, a combination of a lith type light-sensitive material and a lith developer is employed, which enables to form a dot image of greatly high contrast by a specific development effect called a "lith effect".

The lith developer is an alkaline solution wherein the concentration of a sulfite acting as a preservative is generally controlled to extremely low levels and only hydroquinone is used as a developing agent. Where the lith type light-sensitive material is developed with this solution, the tone of the lith type light-sensitive material will generally be higher in contrast with a decrease in the concentration of sulfite ions.

However, since the general properties of the lith type light-sensitive material are greatly influenced by the concentration of the developing agent and are sensitive to changes in the concentration of bromine ions, it is difficult to steadily obtain an image of constant quality. Moreover, because of the markedly low concentration of the sulfite ions as preservatives in the lith developer, the lith developer after being prepared is very low in its resistance to oxygen in air and it is disadvantageously vigorously deteriorated.

Furthermore, in continuously processing the lith type light-sensitive material, the bromine ion is released from an emulsion layer and the developing agent is consumed as is the case with typical silver halide light-sensitive materials. Therefore, even if they are supplemented, it is necessary to check and correct the activity of the developer every several hours. This leads to troublesome or complicated daily production control.

In addition, in processing by such conventional methods, a long development time of from one minute to two minutes at a development temperature of from 25° C. to 35° C. has been needed to obtain sufficient blackening density and dot quality.

Therefore, those methods have eagerly been desired which are able to provide dot images of super high contrast and of good dot quality and screen range.

Japanese patent application (OPI) No. 22438/1976 discloses a method in which in order to avoid the use of the unstable lith developer, a hydroquinone based developing agent is introduced in a silver halide emulsion and the processing is carried out by use of an alkaline activator in the presence of a hydrazine compound such as hydrazine sulfate to obtain a negative image of high contrast.

This method improves the stability of the processing solution and accelerates the processing rate. This method, however, has the disadvantages that the dot quality obtained is inferior to those of conventional lith type light-sensitive materials, the dot characteristics suitable for use in the plate-making using a contact screen cannot be obtained, and that the screen range is of too high contrast, although the contrast characteristics close to those of the lith type light-sensitive material can be obtained. Moreover, for light-sensitive materials in which hydrazine compounds containing a $NH_2NH$— group have been introduced, it is difficult to hold the contrast characteristics obtained at the beginning of the production of the light-sensitive materials for a long period of time which is commercially required. This seems due to the vigorous decomposition of the hydrazine compounds with time. Therefore, no light-sensitive materials capable of providing images of high contrast can be obtained by such a method in which the hydrazine compounds of the type as described above are incorporated in the light-sensitive materials.

U.S. Pat. No. 2,419,975 discloses a method in which a hydrazine compound is added to a silver halide emulsion to obtain a negative image of high contrast. It is described that when the hydrazine compound is added to the silver chlorobromide emulsion and the development is carried out using a developer having a pH value as high as 12.8, the photographic characteristics of markedly high contrast with a $\gamma$ larger than 10 can be obtained. However, many of the hydrazine compounds as disclosed in this patent are of low stability in the light-sensitive materials and cannot be stored for extended periods of time. For strongly alkaline developers having pH values close to 13, developing agents are easily oxidized by air and unstable, and they cannot be stored or used for extended periods of time. Moreover, the development time is nearly equal to those of conventional lith development. Furthermore, for use in the application of the plate-making using a contact screen, such images having only the photographic characteristics of high contrast wherein $\gamma$ is 10 or more are inferior in dot quality, are of too high contrast in screen range, and are not sufficiently satisfactory.

The inventors have developed a method to obtain the photographic characteristics preferred for the reproduction of dot images in which a stable developer is used, and disclosed in Japanese patent application (OPI) No. 37732/1979 (corresponding to U.S. patent application Ser. No. 934,785 filed on Aug. 18, 1978) now U.S. Pat. No. 4,221,857.

According to this method, there can be obtained the good quality which is higher in density than the dot quality obtained by a conventional combination of the lith type photographic light-sensitive material and the lith developer and which is free from fringe. However, no screen range of low contrast could be obtained as in the case where the conventional lith type development is applied.

Hereinafter, the dot quality and the screen range will be explained in detail.

The term "dot quality" means the performance of points when the blackening density is converted through a contact screen in the corresponding point area and, in general, those of lesser fringe are preferred.

The screen range indicates the changes of the dot area relative to the exposure amount. Theoretically it is of the character to be determined by the density pattern of the contact screen used.

Therefore, even by the methods as described in the above cited references, if a contact screen having a density pattern suitable for a light-sensitive material to be used is chosen and used, the desirable gradation will be obtained. However, such choice of the suitable contact screen according to the type of the light-sensitive material used is undesirably very troublesome for those practically engaged in the operation of the plate-making.

Thus it has long been desired to produce light-sensitive materials which permit the formation of good dots, which are of lesser fringe, by use of a stable processing solution and furthermore which enable one to produce the practically same screen range by use of the same contact screen as used in the conventional lith development without employing such a special operation as the choice of the contact screen.

SUMMARY OF THE INVENTION

An object of this invention is to provide a method of forming a negative dot image of markedly high contrast having a gamma ($\gamma$) value of more than 10 by use of a stable processing solution and a stable light-sensitive material.

Another object of this invention is to provide a method of forming a negative dot image by use of a stable processing solution and a stable light-sensitive material which permits the dot image having a good dot quality to be formed more rapidly than in the case that a conventional lith developer is used.

Still another object of this invention is to provide a method of forming a negative dot image by use of a stable processing solution and a stable light-sensitive material which enables to obtain the screen range which is substantially the same as that when a conventional lith developer is used and to avoid the operation of choosing a special contact screen.

It has now been found that these objects can be attained by employing the following method wherein:

- a silver halide photographic light-sensitive material of substantially the surface latent image type which contains in a silver halide emulsion layer or another hydrophilic colloidal layer or layers
- (a) a hydroquinone based developing agent, and
- (b) a compound represented by the formula (I) as indicated below in an amount that does not function as a developer is imagewise exposed to light through a contact screen and thereafter it is processed with an activator aqueous solution having a pH of 11.5 or more.

$$R^1NHNHCOR^2 \qquad (I)$$

wherein $R^1$ represents an aryl group which may be substituted and $R^2$ represents a hydrogen atom, an alkyl group which may be substituted, or an aryl group which may be substituted.

DETAILED DESCRIPTION OF THE INVENTION

Hereinafter the compounds represented by the formula (I) will be explained in greater detail.

The aryl group represented by $R^1$ is a mono- or di-cyclic aryl group, including benzene and naphthalene rings. Particularly preferred among them is the benzene ring.

The aryl group may be substituted, and examples of preferred substituents are as follows:

(1) Straight, branched or cyclic alkyl groups preferably containing 1 to 20 carbon atoms, such as methyl, ethyl, isopropyl, n-dodecyl and cyclohexyl groups.

(2) Mono- or di-cyclic aralkyl groups preferably having an alkyl group containing 1 to 3 carbon atoms, such as, a benzyl group.

(3) Alkoxy groups preferably containing 1 to 20 carbon atoms, for example, methoxy and ethoxy groups.

(4) Amino groups, preferably an amino group ($-NH_2$) or $C_1$ to $C_{20}$ alkyl mono- or di-substituted amino group, for example, dimethylamino and diethylamino groups.

(5) Mono- or di-cyclic aryloxy groups, preferably a phenoxy group.

(6) Acylamino groups preferably containing a $C_1$ to $C_{20}$ alkyl group or a mono- or di-cyclic aryl group, for example, acetylamino, heptylamino, n-tridecanylamino and benzoylamino groups.

(7) Ar—O—E—COHN group (wherein Ar is a mono- or di-cyclic aryl group, preferably a phenyl group, and E is an alkylene group containing 1–10 carbon atoms (e.g., methylene and ethylene groups), or a phenylene group: For example, 2,4-di-tert-amylphenoxyacetylamino and 2-(2,4-di-tert-amylphenoxy)-5-aminobenzoylamino groups.

(8) $A—X—(Y)_n$—wherein (a) X is a divalent connecting residue selected from the following $x_1$ to $x_6$:

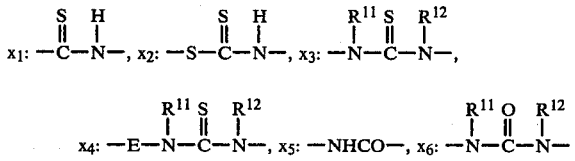

(b) Y is a divalent connecting residue selected from the following $y_1$ to $y_{12}$:

$y_1$: —CONH—, $y_2$: —E—CONH—, $y_3$: —O—E—CONH—, $y_4$: —E—O—E′—CONH—, $y_5$: —S—E—CONH—, $y_6$: $—SO_2NH—$, $y_7$: $—E—SO_2NH—$, $y_8$: —E—, $y_9$: —E—O—E′—, $y_{10}$: —E—S—E′—, $y_{11}$: —NHCONH—, $y_{12}$: —E—NHCONH—(c) n is 0 or 1, wherein $R^{11}$ is a hydrogen atom, an aliphatic group (preferably an alkyl group containing 1 to 20 carbon atoms, a 3, 4, 5 or 6 membered cycloalkyl group, an alkenyl group containing 2 to 20 carbon atoms), and an aromatic residue (preferably a phenyl group or naphthyl group), and $R^{12}$ is a hydrogen atom or an aliphatic group as represented by $R^{11}$. $R^{11}$ and $R^{12}$ may be bonded together to form a 5 to 10-membered ring. Preferred examples of the ring are as follows:

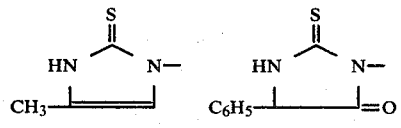

-continued

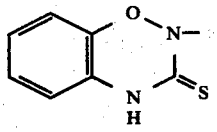

(Only in these cases, therefore, A represents a hydrogen atom.) When $R^{11}$ and $R^{12}$ do not form a ring, one of them is a hydrogen atom.

E and E' are divalent saturated or unsaturated aliphatic groups containing 1–10 carbon atoms (e.g., alkylene containing 1–10 carbon atoms, such as ethylene and 1-methylpropylene, and alkenylene containing 2–10 carbon atoms, such as propenylene and butenylene), divalent aromatic groups (e.g., phenylene, naphthylene and 5-amino-1,2-phenylene) or the like. In $y_{11}$: —E—E', E and E' are different divalent groups, and in $x_{11}$: —E=N—, E is $-(CH_2)_m-CH=$ (wherein m is an integer of 0 or 2).

When n=1, combinations of $x_3$–$y_2$, $x_5$–$y_2$, $x_5$–$y_8$, $x_3$–$y_7$, $x_3$–$y_4$, $x_1$–$y_8$, etc. are particularly preferred.

(d) A is a straight, branched or cyclic alkyl group (preferably containing 1 to 20 carbon atoms, for example, methyl, propyl, n-hexyl, etc.), a mono- or di-cyclic aryl group (e.g., phenyl), a mono- or di-cyclic aralkyl group (preferably containing 7 to 26 carbon atoms, for example, benzyl), a heterocyclic residue (a 5- or 6-membered ring containing at least one hetero atom selected from O, N or S, which may be condensed with an aromatic ring, particularly a benzene ring, and in particular, those heterocyclic residues containing at least one nitrogen atom are preferred, including, in addition to thiazolyl, benzthiazolyl, imidazolyl, thiazolinyl, pyridinyl, tetrazolyl, benztetrazolyl, indazolyl, benzimidazolyl, hydroxytetrazaindene-2 or -3-yl, etc., heterocyclic residues containing a mercapto group, e.g., 2-mercaptobenzthiazolyl, 2-mercaptobenzoxazolyl, etc. and heterocyclic residues containing a quaternary nitrogen atom, e.g., 2-methylbenzthiazolium-3-yl, 2-(N-sulfoethyl-benzthiazolinio), N,N-dimethylbenzimidazolium-2-yl, etc.).

The group represented by A may bear one or more substituents. Examples of such substituents are an alkoxy group (preferably containing 1 to 18 carbon atoms, for example, methoxy), an alkoxycarbonyl group (preferably containing 2 to 19 carbon atoms, for example, ethoxycarbonyl), a mono- or di-cyclic aryl group (for example, phenyl), an alkyl group (preferably 1 to 20 carbon atoms, for example, methyl and t-amyl), a dialkylamino group (preferably containing 1 to 20 carbon atoms, for example, dimethylamino), an alkylthio group (preferably containing 1 to 20 carbon atoms, for example, methylthio), a mercapto group, a hydroxy group, a halogen atom, a carboxy group, a nitro group, a cyano group, a sulfonyl group (preferably containing 1 to 20 carbon atoms, for example, methylsulfonyl), a carbamoyl group (preferably containing 1 to 20 carbon atoms, for example, carbamoyl and dimethylcarbamoyl), and a 5- or 6-membered heterocyclic residue (particularly mercaptotetrazole).

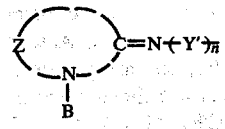

(9)

wherein (a) Z is a group of non-metallic atoms forming together with

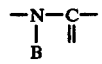

a 5- or 6-membered saturated or unsaturated heterocyclic ring, e.g., thiazoline, benzothiazoline, naphthothiazoline, thiazolidine, oxazoline, benzoxazoline, oxazolidine, selenazoline, benzselenazolidine, imidazoline, benzimidazoline, tetrazoline, triazoline, thiadiazoline, 1,2-dihydropyridine, 1,2-dihydroquinoline, 1,2,3,4-tetrahydroquinoline, perhydro-1,3-oxazine, 2,4-benz[d]oxazine, perhydro-1,3-thiazine, 2,4-benz[d]thiazine, and uracil.

(b) B is a hydrogen atom or a saturated or unsaturated aliphatic group containing 1–22 carbon atoms, for example, an alkyl group (preferably containing 1 to 20 carbon atoms, such as methyl and ethyl), an alkenyl group (containing 2 to 22 carbon atoms, such as allyl), and an alkynyl group (preferably containing 2 to 20 carbon atoms, such as butynyl), which may be substituted by alkoxy, alkylthio, acylamino, acyloxy, mercapto, sulfo, carboxy, hydroxy, haloget, amino and the like.

(c) Y' is the same as Y described in (6).

(d) n is an integer of 0 or 1.

(10) $R^3CONHNH—Ar—Y''—$ wherein (a) $R^3$ is the same as A as described above.

(b) —Ar— is a divalent mono- or di-cyclic aryl group, preferably a phenylene group, which may bear one or more substituents.

(c) Y'' is the same as Y described in (6), with the divalent connecting residues represented by $y_8$ to $y_{10}$ being particularly preferred.

$R^2$ of the formula (I) represents a hydrogen atom and an alkyl (containing 1–20 carbon atoms; may be straight, branched or cyclic) or mono- or di-cyclic aryl group which may be substituted. Examples of such substituents are halogen, cyano, carboxy and sulfo.

Representative examples of alkyl or aryl groups are methyl, ethyl, n-propyl, isopropyl, phenyl, 4-chlorophenyl, 4-bromophenyl, 3-chlorophenyl, 4-cyanophenyl, 4-carboxyphenyl, 4-sulfophenyl, 3,5-dichlorophenyl, 2,5-dichlorophenyl, and the like.

Preferred among the substituents represented by $R^2$ are a hydrogen atom, a methyl group and a phenyl group including substituted ones. The hydrogen atom is particularly preferred.

Of the compounds represented by the formula (I), those described in Japanese patent application (OPI) Nos. 20921/1978 (corresponding to U.S. patent application Ser. No. 823,881 filed on Aug. 11, 1977), 20922/1978, 66732/1978 (these two OPI correspond to U.S. patent application Ser. No. 967,546 filed on Dec. 7, 1978), and 20318/1978 (corresponding to U.S. Pat. No. 4,030,925), Japanese patent application Nos. 125602/1978 (corresponding to U.S. Patent Application Ser. No. 83,750 filed on Oct. 11, 1979) and 82/1979 (corresponding to U.S. patent application Ser. No. 105,689 filed on Dec. 20, 1979), Research Disclosure 17626 (1978, No. 176), etc. are preferred. Particularly preferred compounds are those described in Japanese patent application (OPI) Nos. 10921/1978, 20922/1978 and 66732/1978.

Examples of the compounds represented by the formula (I) are shown below, but this invention is not limited thereto.

I-1 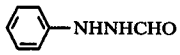

I-2 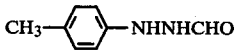

I-3 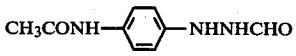

I-4 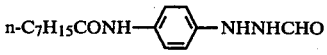

I-5 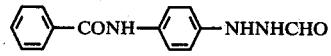

I-6 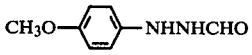

I-7 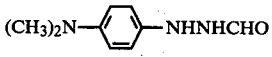

I-8 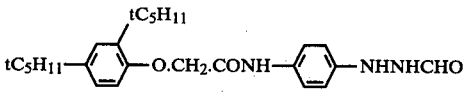

I-9 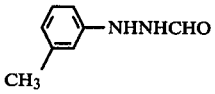

I-10 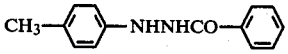

I-11 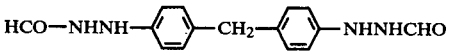

I-12 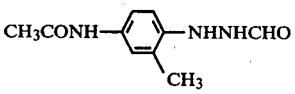

I-13 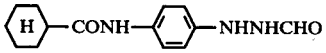

I-14 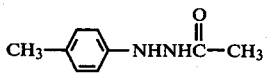

I-15 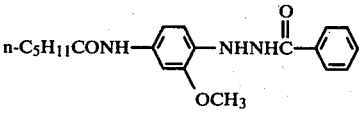

-continued

I-16 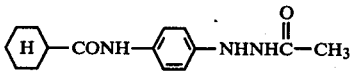

I-17 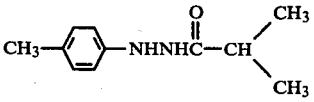

I-18 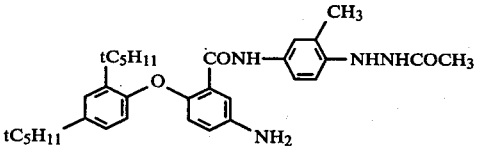

I-19 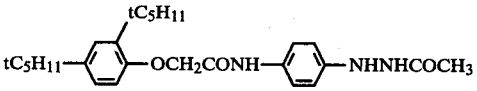

I-20 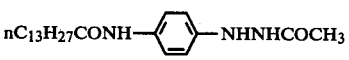

I-21 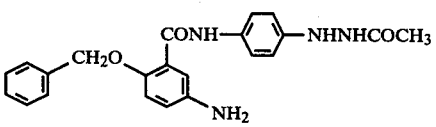

I-22 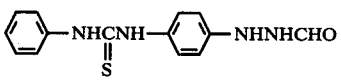

I-23 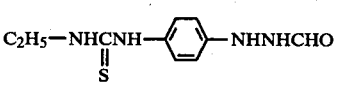

I-24 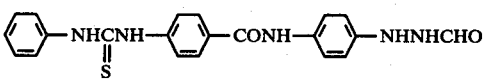

I-25 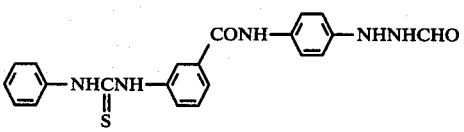

I-26 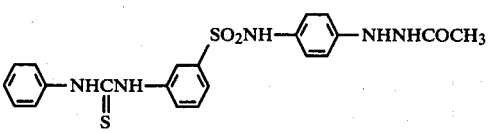

I-27 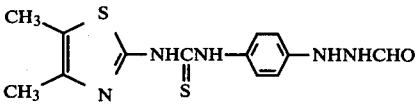

I-28 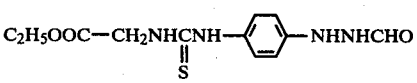

I-29 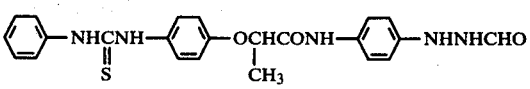

-continued

I-30

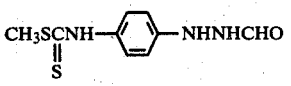

I-31

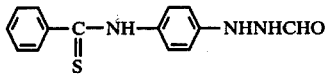

I-32

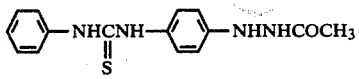

I-33

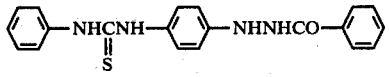

I-34

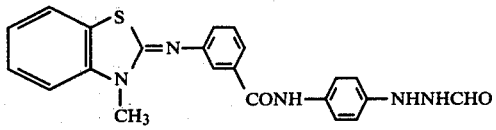

I-35

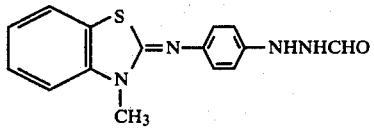

I-36

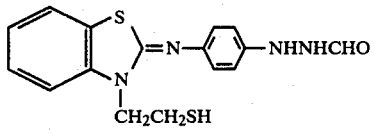

I-37

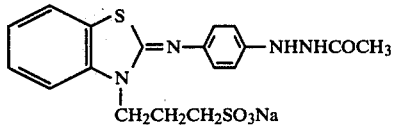

I-38

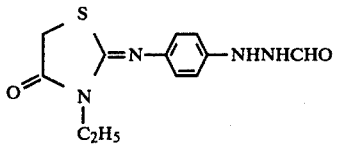

I-39

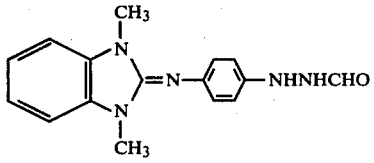

I-40

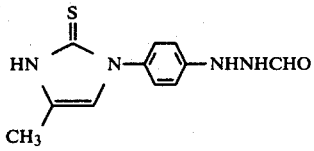

I-41

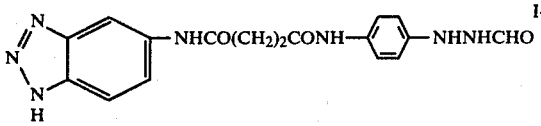

I-42

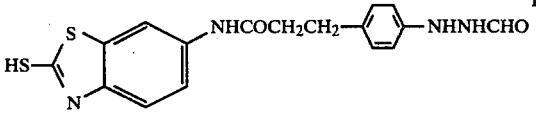

I-43

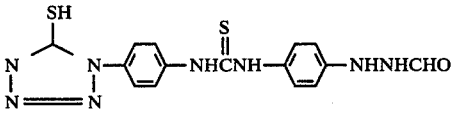

I-44

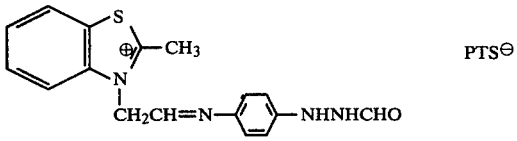

I-45

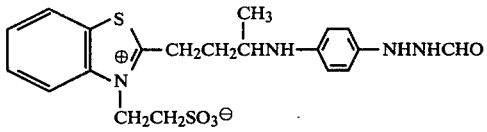

I-46

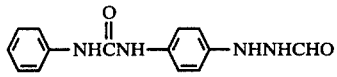

Synthesizing methods of these compounds are described in Japanese patent application (OPI) No. 20318/1978, Japanese patent application Nos. 125602/1978 and 82/1979, etc.

The compounds represented by the general formula (I) can be synthesized by reacting hydrazines with formic acid or by reacting hydrazines with acyl halides. Starting material hydrazines such as

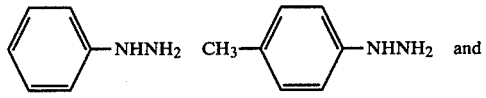

and

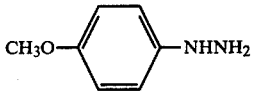

are commercially available and hydrazines of the formula

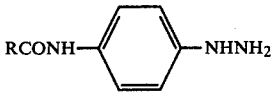

where R represents an alkyl group can be synthesized by reduction of a p-nitrophenylhydrazine. Suitable acyl halides which can be used include aliphatic acyl halides such as acetyl chloride, propionyl chloride, butyryl chloride, etc., and aromatic acyl halides such as benzoyl chloride, toluoyl chloride, etc. The reaction can be conducted in a solvent such as benzene, chloroform, pyridine, triethylamine, etc., and at a temperature of about 0° C. to about 100° C., preferably 0° C. to 70° C. A suitable molar ratio of the hydrazine to the acyl halide in the presence of a base such as pyridine or triethylamine which acts as a hydrogen halide acceptor for the hydrogen halide formed as a by-product ranges from about 1:1 to about 1:3, preferably 1:1.2 to 1:1.5 and in the absence of such a base ranges from about 1:0.3 to about 1:1, preferably 1:0.45 to 1:0.5. Hydrogen halide accepting agents such as triethylamine and pyridine can be employed in an amount of about 1 mol or more per mol of the acyl halide used.

The amount of the compound of the formula (I) being added to the silver halide emulsion layer or other hydrophilic colloidal layers is an amount of such as extent that the compound does not appreciably function as a developer. Usually it is about $10^{-8}$ to $5\times10^{-2}$ mol/mol Ag and preferably about $10^{-6}$ to $5\times10^{-3}$ mol/mol Ag. The amounts of the compound of formula (I) used in the present invention are lower than the amounts that would be used when the compounds are used as developers.

For the incorporation of the compound of the formula (I) in the light-sensitive material, those usually used for the addition of additives to photographic emulsions can be employed. For example, when the compound is water-soluble, it is added as an aqueous solution in a suitable concentration to the photographic emulsion or light-insensitive hydrophilic colloidal solution. On the other hand, when the compound is insoluble or sparingly soluble in water, it is dissolved in a solvent which is selected from organic solvents compatible with water, such as alcohols, glycols, ketones, esters, amides and the like and which exerts no bad influences on the photographic characteristics, and it is added as a solution. In addition, those known methods usually used when water-insoluble (so-called oil-soluble) couplers are added to emulsions in a dispersion form can be employed.

The developing agent for use in this invention is contained in at least one of the silver halide emulsion layer and other hydrophilic colloidal layers. Developing agents which can be used in this invention include hydroquinones such as hydroquinone, chlorohydroquinone, bromohydroqhinone, isopropylhydroquinone, methylhydroquinone, 2,3-dichlorohydroquinone, 2,5-dimethylhydroquinone, t-butylhydroquinone, and hydroquinone monosulfonate (particularly sodium and potassium salts). They can be used alone or in combination with each other. Of these compounds, hydroquinone is the most preferred from the practical standpoint.

The developing agent can be incorporated in the silver halide light-sensitive material by use of hitherto known methods. For example, the developing agent is dissolved in an organic solvent compatible with water which is selected from alcohols, glycols, ketones, esters, amides and the like, and which exerts no bad influences on the photographic characteristics. It is then added as a solution to at least one of the silver halide emulsion and a coating solution to form another layer and coated. The method described in Japanese patent application (OPI) No. 39928/1975 in which a developing agent is dispersed in an oil and added as an oil dispersion to an emulsion can be employed. Moreover, the developing agent can be dissolved in a gelatin solution, added as a gelatin solution, and coated. Furthermore, there can be employed the method described in Japanese Patent Publication No. 15461/1970 (corresponding to U.S. Pat. No. 3,518,088) in which the developing agent is dispersed in alkyl acrylates, alkyl methacrylates, or polymers such as cellulose esters, and the dispersion thus obtained is added and coated.

The amount of the developing agent contained in the silver halide light-sensitive material is about 0.05 to 5 mol per mol of silver halide, preferably about 0.2 to 3 mol per mol of silver halide.

The hydrophilic colloidal layers except for the emulsion layer, as used previously, include, for example, auxiliary layers such as an intermediate layer, an overcoating layer and the like, which are provided on the same side as an emulsion layer or the support of a light-sensitive material.

The silver halide particles as used in this invention are substantially of the surface latent image type. In other words, they are not substantially of the internal latent image type. By the description "substantially of the surface latent image type" as used herein is meant that where after 1 to 1/100 second exposure the development is carried out by a surface development method (A) and an internal development method (B) as shown below, the sensitivity obtained by the surface development method (A) is greater than that obtained by the internal development method (B). The sensitivity as herein is defined as follows:

$$S = \frac{100}{Eh}$$

wherein S is sensitivity, and Eh is an exposure amount required for obtaining a density $\frac{1}{2}$ (Dmax+Dmin) which is just intermediate between the maximum density (Dmax) and the minimum density (Dmin).

Surface Development Method (A)

A light-sensitive material is developed at 20° C. for 10 minutes by use of a developer having the following formulation:

| | |
|---|---|
| N—Methyl-p-aminophenol (Hemisulfate) | 2.5 g |
| Ascorbic Acid | 10 g |
| Sodium Metaborate Water Salt | 35 g |
| Potassium Borate | 1 g |
| Water to make | 1 liter |

Internal Development Method (B)

A light-sensitive material is processed in a bleaching solution containing 3 g/l of Red Prussiate and 0.0125 g/l of phenosafranine at about 20° C. for 10 minutes, then washed with water for 10 minutes, and thereafter developed at 20° C. for 10 minutes in a developer having the following formulation:

| | |
|---|---|
| N—Methyl-p-aminophenol Hemisulfate | 2.5 g |
| Ascorbic Acid | 10 g |
| Sodium Metaborate Tetra-water Salt | 35 g |
| Potassium Bromide | 1 g |
| Sodium Thiosulfate | 3 g |
| Water to make | 1 liter |

If the emulsion is not substantially of the surface latent image type, not only the negative gradation but also the positive gradation are formed, and the objects of this invention cannot be attained.

Silver halide for use in the silver halide light-sensitive material of this invention includes silver chloride, silver chlorobromide, silver bromide, silver iodobromide, and silver iodochlorobromide.

The average grain size of silver halide is preferably not more than about 0.7$\mu$ and more preferably not more than about 0.4$\mu$. The average grain size is a term which is ordinarily used by those in the art of silver halide photography and can easily be understood. By the grain size is meant a grain diameter where the grains are spherical or approximately spherical. Where the grains are cubic, it is calculated from the equation (an edge length)$\times\sqrt{4/\pi}$. The average is an arithmetical or geometric mean calculated based on projected grain areas. The measurement of the average grain size can be effected by referring, for example, to C. E. K. Mees and T. H. James, The Theory of The Photographic Process 3rd, Ed., pp. 36–43, McMillan Co., (1966).

In accordance with the method of this invention, such a silver halide photographic light-sensitive material is first imagewise exposed to light.

This imagewise exposure is conducted by the so-called dot exposure in which as in the exposure of conventional lith type light-sensitve material, the light-sensitive material is imagewise exposed through a contact screen. In the method of this invention, it is not necessary to specially select a contact screen which is suitable to the light-sensitive material to be used, which is different from the conventional substituents for lith type light-sensitive material as described by Japanese patent application (OPI) No. 22438/1976 and U.S. Pat. No. 2,419,975. Thus this invention is advantageous in that by use of the same contact screen as used in the conventional lith type light-sensitive material, equal screen range can be obtained.

The light-sensitive material which has been imagewise exposed to light is processed by an activator aqueous solution of this invention. This activator aqueous solution can contain any component except for those developing agents which are used in conventional lith type developers. Components which can be incorporated in the activator aqueous solution include alkali agents, such as alkali metal hydroxides (e.g., sodium hydroxide, potassium hydroxide), alkali metal carbonates (e.g., sodium carbonate, potassium carbonate, etc.), alkali metal phosphates (e.g., sodium primary phosphate, potassium tertiary phosphate, etc.), alkali metal borates (e.g., sodium borate, sodium metaborate, borax, etc.) and the like, pH buffers, development retarder, such as bromides, iodides, polyalkyleneoxides and the like, and antioxidants (e.g., sodium sulfite, potassium metabisulfite, etc.). Furthermore, as necessary, the activator aqueous solution may contain organic solvents (e.g., diethylene glycol, triethylene glycol, diethanolamine, triethanolamine, etc.), water softeners (e.g., sodium tetrapolyphosphate, sodium hexametaphosphate, sodium nitrilotriacetate, ethylenediamine tetraacetic acid or its sodium salt, etc.), hardeners (e.g., glutaraldehyde, etc.), tackifiers (e.g., carboxymethyl cellulose, hydroxyethyl cellulose, etc.), tone controlling agents, surfactants, defoaming agents, etc.

The pH of the alkaline activator is at least 11.5, preferably at least 12.0 and more preferably at least 12.5.

When the activator processing is carried out in the presence of polyalkylene oxide compounds or their derivatives, much better dot quality can be obtained. By the expression "in the presence of" is meant that the polyalkylene oxide compounds or derivatives thereof are previously added to the light-sensitive material, or they are added to the activator aqueous solution or a prebath.

The polyalkylene oxide compounds or derivatives thereof as used in this invention have average molecular weights of at least 600, and they may be incorporated in the silver halide light-sensitive material or the alkaline activator aqueous solution.

Polyalkylene oxide compounds which can be used in this invention include mixtures of polyalkylene oxides composed of at least 10 units of $C_2$ to $C_4$ alkylene oxide, (e.g, ethylene oxide, propylene-1,2-oxide, butylene-1,2-oxide, etc., preferably ethylene oxide) and compounds containing at least one active hydrogen atom (e.g., water, aliphatic alcohols, aromatic alcohols, aliphatic acids, organic amines, hexytol derivatives, etc.), and block copolymers of two or more polyalkylene oxides.

Representative examples of such polyalkylene oxide compounds are as follows:

Polyalkylene glycols
Polyalkylene glycol alkyl ethers
Polyalkylene glycol aryl ethers
Polyalkylene glycol alkylaryl ethers
Polyalkylene glycol esters
Polyalkylene glycol aliphatic acid amides
Polyalkylene glycol amines
Polyalkylene glycol block copolymers
Polyalkylene glycol graft polymers Two or more polyalkylene oxide chains may be contained in the molecule. In this case, each polyalkylene oxide chain may be composed of less than 10 alkylene oxide units, but the total alkylene oxide units in the molecule should be at least 10. Where two or more polyalkylene oxide chains are contained in the molecule, they may be composed of different alkylene oxide units, for example, ethylene oxide and propylene oxide. Preferred polyalkylene oxide compounds as used in this invention are those containing from about 14 up to 100 of alkylene oxide units.

Representative examples of the polyalkylene oxide compounds as used in this invention are as follows:

$HO(CH_2CH_2O)_{90}H$ II-1

$C_4H_9O(CH_2CH_2O)_{15}H$ II-2

$C_{12}H_{25}O(CH_2CH_2O)_{15}H$ II-3

$C_{18}H_{37}O(CH_2CH_2O)_{15}H$ II-4

$C_{18}H_{37}O(CH_2CH_2O)_{40}H$ II-5

$C_8H_{17}CH{=}CHC_8H_{16}O(CH_2CH_2O)_{15}H$ II-6

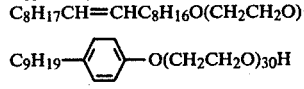
II-7

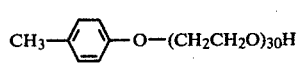
II-8

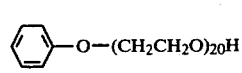
II-9

$C_{11}H_{23}COO(CH_2CH_2O)_{30}H$ II-10

$C_{11}H_{23}COO(CH_2CH_2O)_{24}OCC_{11}H_{23}$ II-11

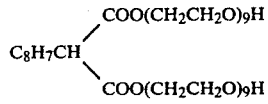
II-12

$C_{11}H_{23}CONH(CH_2CH_2O)_{15}H$ II-13

-continued

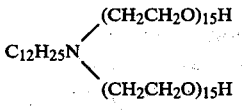

II-14

$C_{14}H_{29}N(CH_3)(CH_2CH_2O)_{24}H$ II-15

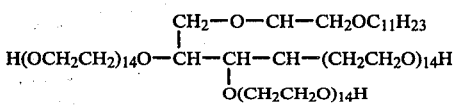

II-16

$H(CH_2CH_2O)_a(CHCH_2O)_b(CH_2CH_2O)_cH$ II-17

$CH_3$ $a + b + c = 50$
$b:a + c = 10:9$

II-18

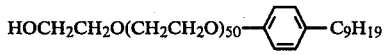

II-19

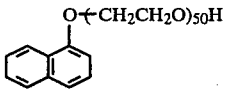

$HO(CH_2CH_2O)_a(CH_2CH_2CH_2CH_2O)_b(CH_2CH_2)_cH$ II-20

$a + c = 30, b = 14$ $HO(CH_2CH_2O)_a(CHCH_2O)_b(CH_2CH_2O)_cH$ II-21

$b = 8\ a + c = 50$

II-22

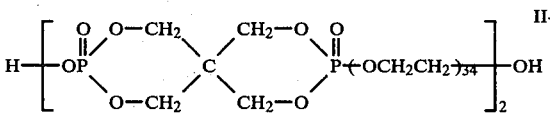

II-23

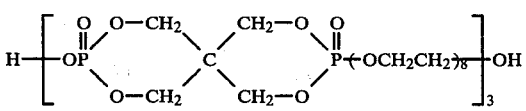

$HO(CH_2CH_2O)_{34}H$ II-24

The polyalkylene oxide compounds described above are disclosed in Japanese Patent Application (OPI) No. 156423/1975 (corresponding to U.S. Pat. No. 4,011,082), 108130/1977 and 3217/1978, and they may be used singly or in admixtures comprising two or more thereof. The polyalkylene oxide compounds may be added into a light-sensitive material and they may also be added into an activator aqueous solution.

Where the polyalkylene oxide compound is added to the silver halide emulsion, it can be added as a suitable concentration of an aqueous solution or after being dissolved in a low boiling point organic solvent compatibel with water, at an appropriate stage prior to the coating, preferably after the chemical aging. It may be added not to the emulsion but to a light-insensitive hydrophilic layer, for example, to an intermediate layer, a protective layer or a filter layer.

Where the polyalkylene oxide compound is added to the alkaline activator solution, it can be added as it is (in a solid form) or as a suitable concentration of an aqueous solution or after being dissolved in a low boiling point organic solvent compatible with water.

The polyalkylene oxide compound of this invention can be added to the light-sensitive material in an amount ranging between about $5\times10^{-4}$ g and 5 g per mole of silver halide, preferably between $1\times10^{-3}$ g and 1 g per mole of silver halide. On the other hand, where it is added to the alkaline activator solution, it is added in an amount of at least about $1\times10^{-2}$ per liter of the activator solution, preferably in an amount ranging between $5\times10^{-2}$ g and 40 g per liter of the activator solution.

For the purpose of improving the dot quality and controlling the screen range, the following additives which are known as antifoggants can be used: indazoles such as 5-nitroindazole and 6-nitroindazole, imidazoles such as 5-nitrobenzimidazole, triazoles such as 5-nitrobenztriazole, 5-methylbenztriazole, benztriazole, 5-chlorobenztriazole and 5-bromobenztriazole, mercapto compounds such as 2-mercaptobenzthiazole, 2-mercaptobenzimidazole and 1-phenyl-5-mercaptotetrazole, pyrimides such as 2-mercapto-4-hydroxy-6-methyl pyrimidine, pyrazoles and the like.

These organic compounds can be added to any of the silver halide light-sensitive material and the alkaline activator.

The conditions under which the light-sensitive material is processed with the activator aqueous solution of this invention can be determined properly. While the usual processing temperature is in the range of from 18° C. to 50° C., the processing of this invention can be carried out at temperatures falling outside the above range. The processing time is very short and times of about 10 seconds are sufficient.

The processing using the activator aqueous solution of this invention is usually carried out by immersing the light-sensitive material in the activator aqueous solution. During this immersion, the activator aqueous solution can be stirred. For this stirring there are employed various known methods, for example, a method using stirring blades and a method of blowing inert gases. Such stirring, however, sometimes gives rise to the problem that the dot quality is likely to vary, probably owing to the change in the state of stirring.

Surprisingly the variation of the dot quality caused by the stirring of the activator aqueous solution can be prevented by adding to the activator aqueous solution the compounds represented by the formula (III):

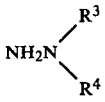

(III)

wherein $R^3$ is a hydrogen atom or a lower alkyl group, and $R^4$ is a hydrogen atom, a lower alkyl group, a lower alkenyl group, an alkoxycarbonyl group, a heterocyclic group, a carbamoyl group, a carbazoyl group, an acyl group or a phenyl group. These groups may be substituted.

Preferred among the alkyl group represented by $R^3$ are those containing 1 to 3 carbon atoms, such as methyl, ethyl, n-propyl and isopropyl. With regard to the alkyl group represented by $R^4$, those containing 1 to 3 carbon atoms, such as methyl, ethyl, n-propyl, isopropyl and allyl, are preferred. These alkyl groups may be substituted by a hydroxy group, for example.

Preferred among the lower alkenyl group represented by $R^4$ are those containing 1 to 3 carbon atoms such as vinyl and allyl.

Preferred alkoxycarbonyl groups represented by $R^4$ are those containing 2 to 4 carbon atoms such as methoxycarbonyl, ethoxycarbonyl, n-propoxycarbonyl and isopropoxycarbonyl.

Preferred acyl groups represented by $R^4$ are those containing 1 to 4 carbon atoms such as formyl, acetyl, propionyl, n-butyryl and isobutyryl.

Preferred heterocyclic groups represented by $R^4$ are 5- or 6-membered nitrogen-containing heterocyclic groups, to which may be condensed 6-membered rings. Examples of such groups are pyrrolyl, imidazolyl, pyridyl, benzothiazolyl, quinolyl and indolyl.

Alkyl groups by which the phenyl group represented by $R^4$ may be substituted are preferably those lower alkyl groups containing 1 to 3 carbon atoms such as methyl and isopropyl.

Preferred among the compounds represented by the formula (III) are those wherein $R^3$ and $R^4$ are both hydrogen, those wherein at least one of $R^3$ and $R^4$ is a lower alkyl group, and those wherein $R^3$ is a hydrogen atom and $R^4$ is a phenyl group which may be substituted by a lower alkyl group or groups. Particularly preferred compounds are those wherein $R^3$ and $R^4$ are both hydrogen atoms (hydrazine).

The compounds represented by the formula (III) are contained in the activator. Representative examples are shown below, but this invention is not limited thereto.

$NH_2NH_2$ III-1

$NH_2NHCOOC_2H_5$ III-2

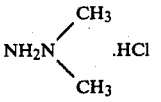
III-3

$NH_2NHCH_2CH_2OH$ III-4

$NH_2NHC(=O)NH_2.HCl$ III-5

$NH_2NHC(=O)NHNH_2.HCl$ III-6

$NH_2NHC(=O)CH_3$ III-7

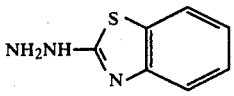
III-8

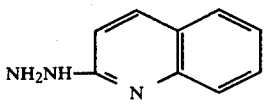
III-9

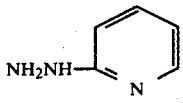
III-10

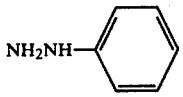
III-11

-continued

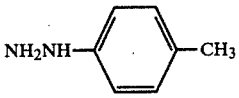
III-12

In addition to the compounds as described above, their salts, for example, sulfuric acid salts, hydrochloric acid salts, bromic acid salts and phosphoric acid salts, and their hydrates can be used.

The amount of the compound of the formula (III) being added to the activator aqueous solution is preferably from about $10^{-4}$ mole/l to 1 mole/l, with the range of from about $10^{-3}$ mole/l to $5\times10^{-1}$ mole/l being particularly preferred.

As a binder or a protective colloid for the photographic emulsion of the light-sensitive material for use in this invention, it is advantageous to use gelatin. Of course, other hydrophilic colloids can be used, including gelatin derivatives, graft polymers of gelatin and other polymers, proteins such as albumin and casein, cellulose derivatives such as hydroxyethyl cellulose, carboxymethyl cellulose and cellulose sulfate, sodium alginate, sugar derivatives such as starch derivatives, and various kinds of hydrophilic synthetic homo- or co-polymers such as polyvinyl alcohol, polyvinyl alcohol partial acetal, poly-N-vinyl pyrrolidone, polyacrylic acid, polymethacrylic acid, polyacrylamide, polyvinyl imidazole and polyvinyl pyrazole.

Gelatins which can be used in this invention include lime processed gelatin, acid processed gelatin, gelatin hydrolyzates, gelatin enzyme decomposition products. Gelatin derivatives as herein used are those obtained by reacting gelatin with various compounds such as acid halides, acid anhydrides, isocyanates, bromo acetic acid, alkane sultones, vinyl sulfonamides, maleinimide compounds, polyalkylene oxides and epoxy compounds. Representative examples are described in U.S. Pat. Nos. 2,614,928, 2,132,945, 3,186,846, 3,312,553, British Pat. Nos. 861,414, 1,033,189, 1,005,784, Japanese patent Publication No. 26845/1967, etc.

Gelatin graft polymers which can be used in this invention are those prepared by grafting on gelatin homo- or copolymers of vinyl monomers such as acrylic acid, methacrylic acid or their derivatives, e.g., esters and amides, acrylonitrile and styrene. In particular, graft polymers of gelatin and polymers which are compatible with gelatin to a certain extent, such as polymers of acrylic acid, methacrylic acid, acrylamide, methacrylamide, and hydroxyalkyl methacrylate, are preferred. Examples of such graft polymers are described in U.S. Pat. Nos. 2,763,625, 2,831,767, 2,956,884, etc.

Typical hydrophilic synthetic polymer materials are described in West German patent application (OLS) No. 2,312,708, U.S. Pat. Nos. 3,620,751 and 3,879,205, and Japanese Patent Publication No. 7561/1968.

The silver halide emulsion for use in this invention may not be chemically sensitized, but it is preferred that it is chemically sensitized. For the chemical sensitization of the silver halide emulsion, a sulfur sensitization method, a reduction sensitization method and a noble metal sensitization method are known. A typical noble metal sensitization method is a gold sensitization method wherein a gold compound mainly a gold complex salt is used. In addition to the gold complex salt, complex salts of platinum, palladium, iridium and the like are advantageously used. The reduction sensitization method can be used to such an extent not to cause fog which constitutes a practical hindrance.

These sensitization methods are described in P. Glafkides Chimie et Physique Photographiqe, Paul Montel (1967), L. Zelikman et al, Making and Coating Photographic Emulsion, The Focal Press (1964), and H. Frieser, Die Grundlagen der Photographischen Prozesse mit Silberhalogeniden, Akademische Verlagsgesellschaft (1968).

Sulfur sensitizers which can be used for sulfur sensitization are thiosulfates, thioureas, thiazoles, rhodanines and other compounds. Examples of such sensitizers are described in U.S. Pat. Nos. 1,574,944, 2,410,689, 2,278,947, 2,728,668 and 3,656,955.

Reduction sensitizers which can be used for reduction sensitization are stannous salts, amines, formamidinesulfinic acid, silane compounds and the like. Examples of such reduction sensitizers are described in U.S. Pat. Nos. 2,487,850, 2,518,698, 2,983,609, 2,983,610 and 2,694,637.

For noble metal sensitization, the complex salts of the metals of Group VIII of the Periodic Table can be used. Examples of such metal complex salts are described in U.S. Pat. No. 2,448,060, British Pat. No. 618,061, etc.

The photographic emulsion of this invention can be prepared by the methods as described in G. F. Duffin, Photographic Emulsion Chemistry, The Focal Press (1966) and the above described books of P. Glafkides and L. Zelikman et al; that is, any of the acidic method, the neutral method, the ammonia method, etc. can be employed. For the reaction of the type that a soluble silver salt and a soluble halogen salt are reacted, the single jet mixing method, the simultaneous mixing method or a combination thereof can be used. There can also be employed a method wherein grains are formed in the presence of an excess of silver ions (so-called reverse mixing method).

As one simultaneous mixing method, there can be used a method wherein the pAg in the liquid phase in which silver halide is to be formed is kept constant; that is, the so-called controlled double jet method. This method permits the formation of silver halide which is regular in the crystal shape and is nearly uniform in the grain size.

While the silver halide grains for use in the photographic emulsion of this invention can have a relatively broad grain size distribution, they preferably have a narrow grain size distribution. In particular, it is preferred that the sizes of the grains constituting 90% by weight or by number of the total silver halide grains fall within ±40% of the average grain size. Generally, such an emulsion is called a monodisperse emulsion.

The crystal structure of the silver halide grain for use in the photographic emulsion may be regular, e.g., cubic or octahedral, or irregular, e.g., spherical or plate-like, or in a composited form thereof. A mixture of grains having various crystal structures can be used. The silver halide grain may be composed of an interior portion and a surface layer which are different in phase from each other, or may be composed of the same or uniform phase.

During the silver halide grain formation or physical aging, a cadmium salt, a zinc salt, a lead salt, a thallium salt, iridium or its complex salt, a rhodium salt or its complex salt, an iron salt or its complex salt, etc. are allowed to be present at the same time.

Two or more silver halide emulsions which have separately been produced may be mixed.

After the precipitate formation or physical aging, the soluble salts are usually removed from the emulsion. For the removal of such soluble salts, there may be used a noodle water-washing method which has long been known wherein gelatin is gelled; and a flocculation method wherein inorganic salts composed of polyvalent anions, such as sodium sulfate, anion surface active agents, anionic polymers (e.g., polystyrene sulfonic acid), or gelatin derivatives (e.g., aliphatic acylated gelatin, aromatic acylated gelatin, aromatic carbamoylated gelatin, etc.) are used. This step of removing the soluble salts may be omitted.

The addition of a small amount of iodide (e.g., potassium iodide) after the grain formation, prior to the chemical aging, after the chemical aging or prior to the coating further increases the effect of this invention. This iodide is preferably added in an amount of about $10^{-4}$ to $3\times10^{-2}$ mol/mol Ag and particularly preferably in an amount of about $10^{-4}$ to $10^{-2}$ mol/mol Ag.

The silver halide emulsion of this invention may contain an antifoggant. The incorporation of such an antifoggant is preferred for achieving the objects of this invention.

Antifoggants which are advantageously used in the emulsion of this invention include 1,2,3-triazole compounds, 1,2,4-triazole compounds which are substituted by a mercapto group at the 3-position, 2-mercaptobenzimidazole compounds, 2-mercaptopyrimidines, 2-mercaptobenzothiazoles, benzothiazolium compounds (e.g., N-alkylbenzothiazolium halide, N-allylbenzothiazolium halide), 2-mercapto-1,3,4-thiazoles, and 4-mercapto-1,3,3a,7-tetrazaindenes.

Particularly preferred antifoggants are benzotriazoles. The benzene ring of such benzotriazoles may be substituted by one or more substituents selected from an alkyl group (e.g., methyl, heptyl), a halogen atom (e.g., chlorine, bromine), an alkoxy group (e.g., methoxy), an acyl group (e.g., acetyl, benzoyl), an acylamino group (e.g., acetylamino, capryloylamino, benzoylamino, benzenesulfonylamino), a carbamoyl group (e.g., methylcarbamoyl, phenylcarbamoyl), a sulfamoyl group (e.g., methylsulfamoyl, phenylsulfamoyl), and an aryl group (e.g., phenyl, tolyl). The alkyl group portion of such a substituent preferably contains 12 or less carbon atoms and particularly preferably 3 or less carbon atoms. The benzotriazole may be substituted by a halogen atom (e.g., chlorine, bromine) at the 1-position thereof.

In the silver halide photographic light-sensitive material for use in this invention can be incorporated a hydroxytetrazaindene compound. The incorporation of such a hydroxytetrazaindene compound further increases the effects of this invention, high sensitization, high gradation and an improvement in dot quality. Preferred hydroxytetrazaindene compounds are 4-hydroxy-1,3,3a,7-tetrazaindene compounds, with 4-hydroxy-6-methyl-1,3,3a,7-tetrazaindene being especially preferred.

The photographic emulsion of this invention may be spectrally sensitized with methine dyes and the like. Dyes which are used for this spectral sensitization include a cyanine dye, a merocyanine dye, a composite cyanine dye, a composite merocyanine dye, a halopolar cyanine dye, a hemicyanine dye, a styryl dye, and a hemioxonol dye. Particularly useful dyes are those belonging to the cyanine group, the merocyanine dye and the composited merocyanine dye.

To these dyes are applicable any of nuclei which are usually utilized as basic heterocyclic ring nuclei for cyanine dyes; that is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; those nuclei wherein the above nuclei are fused with an aliphatic hydrocarbon ring; and those nuclei wherein the above nuclei are fused with an aromatic hydrocarbon ring, i.e., an indolenine nucleus, a benzindolenine nucleus, an indole nucleus, a benzoxazole nucleus, a naphthooxazole nucleus, a benzothiazole nucleus, a naphthothiazole nucleus, a benzoselenazole nucleus, a benzimidazole nucleus, a quinoline nucleus, etc. These nuclei may be substituted in the carbon atom.

To the merocyanine dye or composite merocyanine dye are applicable as nuclei having a ketomethylene structure 5- or 6-membered heterocyclic nuclei such as a pyrazoline-5-on nucleus, a thiohydantoin nucleus, a 2-thiooxazolidine-2,4-dion nucleus, a thiazolidine-2,4-dion nucleus, a rhodanine nucleus and a thiobalbituric acid nucleus.

Useful sensitizing dyes are described, for example, in German Pat. No. 929,080, U.S. Pat. Nos. 2,231,658, 2,493,748, 2,503,776, 2,519,001, 2,912,329, 3,656,959, 3,672,897, 3,694,217, British Pat. No. 1,242,588, Japanese patent Publication No. 14030/1969.

These sensitizing dyes may be used singly or in admixtures comprising two or more thereof. Such combinations of the sensitizing dyes are often used for the purpose of, in particular, super sensitization. Representative examples of such combinations are described in U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609, 3,837,862, British Patent No. 1,344,281, Japanese patent Publication No. 4936/1968, etc.

In the emulsion may be incorporated, in combination with the sensitizing dye, a dye which itself has no spectral sensitization action or a substance which does not materially absorb visible light and which exhibits super sensitization. Examples of such dyes or substances are aminostylben compounds substituted by a nitrogen-containing heterocyclic group (e.g., those as described in U.S. Patent Nos. 2,933,390 and 3,635,721), aromatic organic acid-formaldehyde condensates (e.g., those as described in U.S. Pat. No. 3,734,510), cadmium salts and azaindene compounds. Combinations as described in U.S. Pat. Nos. 3,615,613, 3,615,641, 3,617,295 and 3,635,721 are particularly useful.

The emulsion of this invention may contain a water-soluble dye as a filter dye or for various purposes, for example, for the prevention of irradiation. Such water-soluble dyes include an oxonol dye, a hemioxonol dye, a styryl dye, a merocyanine dye, a cyanine dye and an azo dye. Of these dyes, the oxonol dye, hemioxonol dye and merocyaine dye are useful. Representative examples of dyes which can be used are described in British Pat. Nos. 584,609, 1,177,429, Japanese patent application Nos. 85130/1973, 99620/1974, 114420/1974, U.S. Patent Nos. 2,274,782, 2,533,472, 2,956,879, 3,148,187, 3,177,078, 3,247,127, 3,540,887, 3,575,704, 3,653,905, 3,718,472.

The emulsion of this invention may contain an inorganic or organic hardener. The following can be used singly or in combination with each other: chromium salts (e.g., chromium alum, chromium acetate), aldehydes (e.g., formaldehyde, glyoxal, glutaraldehyde, etc.), N-methylol compounds (e.g., dimethylol urea, methylol dimethyl hydantoin, etc.), dioxane derivatives (e.g., 2,3-dihydroxydioxane, etc.), active vinyl compounds (1,3,5-triacryloyl-hexahydro-s-triazine, (bis(-vinylsulfonyl)methyl ether, N,N'-methylene-bis-[β-(vinylsulfonyl)propionamide], etc.), active halogen compounds (2,4-dichloro-6-hydroxy-s-triazine, etc.), mucohalogenic acids (e.g., mucochloric acid, mucophenoxy chloric acid, etc.), isooxazoles, dialdehyde starch, 2-chloro-6-hydroxytriazynilated gelatin, etc.

Representative examples of such hardners are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644, 3,543,292, British Pat. Nos. 676,628, 825,544, 1,270,578, German Patent Nos. 872,153, 1,090,427, Japanese Patent Publication Nos. 7133/1959, 1872/1971, etc.

In the photographic emulsion of this invention may be incorporated various known surfactants for various purposes: as an auxiliary coating agent or an antistatic agent, or for an improvement in slipping property, emulsification and dispersion and photographic characteristics, or for the prevention of adhesion. Examples of such surfactants are nonionic surfactants such as saponin (steroid based), polyalkylene glycol alkylamine or amides, polyethylene oxide adducts of silicon), glycidol derivatives (e.g., alkenylsuccinic acid glyceride, alkylphenol polyglyceride), aliphatic acid esters of polyhydric alcohols, alkylesters, urethanes or ethers of sugar, etc.; anion surfactants containing acid groups, e.g., a carboxy group, a sulfo group, a phospho group, a sulfate group or a phosphate group, such as triterpenoid based saponin, alkylcarboxylic acid salts, alkylsulfonic acid salts, alkylbenzenesulfonic acid salts, alkylnaphthalenesulfonic acid salts, alkylsulfuric acid esters, alkylphosphoric acid esters, N-acyl-N-alkyltaurines, sulforsuccinic acid esters, sulfoalkylpolyoxyethylene alkylphenyl ethers and polyoxyethylene alkylphosphoric acid esters; amphoteric surfactants such as amino acids, aminoalkylsulfonic acids, aminoalkylsulfonic acid esters, aminoalkylphosphoric acid esters, alkylbetaines, amineimides and amineoxides; and cation surfactants such as alkylamine salts, aliphatic or aromatic quaternary ammonium salts, heterocyclic quaternary ammonium salts such as pyridinium and imidazolium, and aliphatic or heterocyclic group-containing phosphonium or sulfonium salts.

For the purpose of improving the dimension stability, etc., a dispersion of a water-insoluble or sparingly soluble synthetic polymer can be incorporated into the photographic emulsion of this invention. For example, homo- or co-polymers of alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefin, styrene and the like, and copolymers of the above monomers and acrylic acid, methacrylic acid, α,β-unsaturated dicarboxylic acid, hydroxyalkyl acrylate or methacrylate, sulfoalkyl acrylate or methacrylate, styrenesulfonic acid and the like can be used. In more detail, there can be used those polymers as described in U.S. Pat. Nos. 2,376,005, 2,739,137, 2,853,457, 3,062,674, 3,411,911, 3,488,708, 3,525,620, 3,607,290, 3,635,715, 3,645,740, British Patent Nos. 1,186,699, 1,307,373.

The contrast emulsion as herein used is suitable for the reproduction of line originals. In such an application, the dimensional stability is important and therefore it is preferred to incorporate such a polymer dispersion.

According to this invention, the stability of the processing solution can markedly be increased and the control operation of the processing solution can be reduced in comparison with the conventional method wherein the lith type light-sensitive material and the infectious developer are used and furthermore a negative image of extremely high contrast which is equal in dot quality and screen range to that obtained by the conventional method can be obtained in a markedly short period of time. Additionally, in comparison with the method wherein the light-sensitive material to which the known hydrazine compound is added and the developer with a high pH value are used, the stabilities of not only the processing solution but also the light-sensitive material can be improved. Moreover, in comparison with the method wherein the light-sensitive material to which only hydroquinone is added and the activator to which a hydrazine compound is added are used, there can be obtained a negative image of very high contrast which is markedly excellent in dot quality and screen range. In addition, no special choice of contact screen is required, and by using a contact screen used in the exposure of the usual lith type light-sensitive material, practically the same halftone gradation as in the lith-type light-sensitive material can be obtained. In these respects, the method of this invention is better than that described in Japanese patent application (OPI) No. 37732/1979 (corresponding to U.S. patent application Ser. No. 934,785 filed on Aug. 18, 1978).

Moreover, according to an embodiment of this invention, the light-sensitive material containing the developing agent and the compound represented by the formula (I) is processed with the alkaline activator containing the compound represented by the formula (III). Therefore, there can be obtained the great advantage that in comparison with processing wherein only the alkaline activator is used, the dot quality is further improved and no variation in dot quality occurs even if the stirring conditions of the activator varies.

The following examples are given to illustrate this invention in greater detail, but this invention is not limited thereto.

EXAMPLE 1

By adding an aqueous solution of silver nitrate and an aqueous solution of potassium bromide at the same time over a period of 50 minutes to an aqueous solution of gelatin kept at 50° C. while maintaining the pAg at 7.9, a silver bromide emulsion having an average grain size of 0.25μ was prepared. After the removal of soluble salts by a conventional method, sodium thiosulfate was added to the silver bromide emulsion in the amount of 43 mg per mole of silver bromide and then the silver bromide emulsion was subjected to chemical aging at 60° C. for 60 minutes. This emulsion contained gelatin in the amount of 120 g per mole of silver bromide.

To this emulsion were added hydroquinone dissolved in a 10% aqueous solution of gelatin, 5-methylbenzotriazole as an antifoggant and furthermore a 2-hydroxy-4,6-dichloro-1,3,5-triadine sodium salt as a hardener. The resulting mixture was then coated on a cellulose triacetate film so that the amount of silver be 45 mg per 100 $cm^2$ of the film. The amount of the hydroquinone coated was 22 mg per 100 $cm^2$ (52.8 g/mole Ag). This film sample is designated as Film No. 10.

Additionally, films were produced in the same manner as for Film No. 11 except that the compounds of the formula (I) as illustrated in Table 1 were used. These films are designated as Film Nos. 2 to 9 and 11 to 18.

Additionally, in producing a film by the same method as used for the production of Film Nos. 2, 13 and 17, Compound II-7, polyalkylene oxide derivative, was added in the amount of 0.4 g/mole Ag. The film so obtained is designated as Film No. 9.

By use of a 150 line magenta contact screen, these films were exposed to light through an exposure wedge for sensitometry and thereafter they were developed at 27° C. for 10 seconds with an alkaline activator having the formulation as described below, stopped, fixed, washed with water and dried to examine their photographic characteristics.

| Activator (A) | |
|---|---|
| Anhydrous Sodium Sulfite | 2.0 g |
| Potassium Bromide | 5.0 g |
| Potassium Carbonate | 40.0 g |
| Sodium Hydroxide | 30.0 g |
| Water to make | 1 liter |

For comparison, a lith light-sensitive material (Fuji Lith VO-100) commercially available for halftone photography was exposed in the same manner as above and developed by use of a commercially available lith developer (Fuji Lith Liquid Developer HS-1) at 27° C. for 1 minute and 40 seconds (development time required for obtaining the maximum dot quality). The film so obtained was designated as Film No. 23.

For comparison with light-sensitive materials containing no developing agents, films were produced in the same manner as for Film Nos. 9 and 11 except that no hydroquinone was added. These films are designated as Film Nos. 21 and 22. They were developed by use of Developer B having the following formulation containing hydroquinone at 27° C. for 1 minute and 45 seconds and thereafter subjected to usual fixing, water-washing and drying processings. This experiment is the same as Run No. 5 of Example 1 of Japanese patent application (OPI) No. 37732/1979 (corresponding to U.S. patent application Ser. No. 934,785, filed on Aug. 18, 1978).

| Developer (B) | |
|---|---|
| Ethylenediaminetetraacetic Acid 4-Sodium Salt | 1.0 g |
| Potassium Bromide | 5.0 g |
| Sodium Sulfite | 75.0 g |
| Hydroquinone | 28.0 g |
| Sodium Carbonate Monohydrate | 12.0 g |
| Potassium Hydroxide | 25.0 g |
| 5-Nitroindazole | 50 mg |
| Water to make | 1 liter |

In order to compare the stability of the processing solution, the processing solution was placed in an automatic developing apparatus and allowed to stand therein for 4 days and, thereafter, in the same manner as described above, the development processing was carried out to examine the photographic characteristics.

The results are shown in Table 1. The dot quality was visually evaluated and graded into five classes (1) to (5), (1) and (5) indicating respectively the best and the worst. As a dot original plate for plate-making, only (1) and (2) are practical, and (3), (4) and (5) are unsatisfactory.

The screen range is shown by the difference between the logarithm of an exposure amount providing a dot area of 5% and that of an exposure amount providing a dot area of 95%. Greater values indicate lower contrasts.

TABLE 1

| | | Amount of Hydroquinone added (g/mole Ag) | Hydrazine Compound: Compound | Hydrazine Compound: Amount added (mole mole Ag) | Polyalkylene oxide: Compound | Polyalkylene oxide: Amount added (g/mole Ag) | Processing Solution | Processed with Fresh Solution: Sensitivity* | Processed with Fresh Solution: Dot Quality | Processed with Fresh Solution: Screen Range | Processed with Old Solution: Sensitivity* | Processed with Old Solution: Dot Quality | Processed with Old Solution: Screen Range |
|---|---|---|---|---|---|---|---|---|---|---|---|---|---|
| 1 | Control | 52.8 | none | — | none | — | Activator B | 32 | 5 | 1.20 | 32 | 5 | 1.45 |
| 2 | Invention | 52.8 | I-1 | $1.3 \times 10^{-3}$ | none | — | Activator B | 118 | 2 | 1.40 | 118 | 2 | 1.40 |
| 3 | Invention | 52.8 | I-2 | $1.0 \times 10^{-3}$ | none | — | Activator B | 120 | 2 | 1.40 | 120 | 2 | 1.40 |
| 4 | Invention | 52.8 | I-4 | $1.0 \times 10^{-3}$ | none | — | Activator B | 115 | 2 | 1.40 | 115 | 2 | 1.40 |
| 5 | Invention | 52.8 | I-6 | $0.8 \times 10^{-3}$ | none | — | Activator B | 110 | 2 | 1.40 | 110 | 2 | 1.40 |
| 6 | Invention | 52.8 | I-8 | $0.8 \times 10^{31\ 3}$ | none | — | Activator B | 120 | 2 | 1.40 | 120 | 2 | 1.40 |
| 7 | Invention | 52.8 | I-9 | $1.1 \times 10^{-3}$ | none | — | Activator B | 110 | 2 | 1.40 | 110 | 2 | 1.40 |
| 8 | Invention | 52.8 | I-10 | $5.0 \times 10^{-3}$ | none | — | Activator B | 120 | 2 | 1.40 | 120 | 2 | 1.40 |
| 9 | Invention | 52.8 | I-12 | $1.2 \times 10^{-3}$ | none | — | Activator B | 115 | 2 | 1.40 | 115 | 2 | 1.40 |
| 10 | Invention | 52.8 | I-2 | $1.0 \times 10^{-3}$ | II-7 | 0.4 | Activator B | 100 | 1 | 1.45 | 100 | 1 | 1.40 |
| 11 | Invention | 52.8 | I-22 | $5 \times 10^{-5}$ | none | — | Activator B | 105 | 2 | 1.40 | 105 | 2 | 1.40 |
| 12 | Invention | 52.8 | I-23 | $7.5 \times 10^{-5}$ | none | — | Activator B | 110 | 2 | 1.40 | 110 | 2 | 1.40 |
| 13 | Invention | 52.8 | I-25 | $5 \times 10^{-5}$ | none | — | Activator B | 118 | 2 | 1.40 | 118 | 2 | 1.40 |
| 14 | Invention | 52.8 | I-26 | $4 \times 10^{-5}$ | none | — | Activator B | 115 | 2 | 1.40 | 115 | 2 | 1.40 |
| 15 | Invention | 52.8 | I-31 | $5.5 \times 10^{-5}$ | none | — | Activator B | 104 | 2 | 1.40 | 104 | 2 | 1.40 |
| 16 | Invention | 52.8 | I-35 | $6 \times 10^{-5}$ | none | — | Activator B | 110 | 2 | 1.40 | 110 | 2 | 1.40 |
| 17 | Invention | 52.8 | I-36 | $4.5 \times 10^{-5}$ | none | — | Activator B | 110 | 2 | 1.40 | 110 | 2 | 1.40 |
| 18 | Invention | 52.8 | I-39 | $5 \times 10^{-5}$ | none | — | Activator B | 108 | 2 | 1.40 | 108 | 2 | 1.40 |
| 19 | Invention | 52.8 | I-25 | $5 \times 10^{-5}$ | II-7 | 0.4 | Activator B | 98 | 1 | 1.40 | 100 | 2 | 1.40 |
| 20 | Invention | 52.8 | I-36 | $4.5 \times 10^{-5}$ | II-7 | 0.4 | Activator B | 100 | 1 | 1.45 | 100 | 1 | 1.20 |
| 21 | Comparative | none | I-2 | $1.0 \times 10^{-3}$ | II-7 | 0.4 | Developer B | 120 | 2 | 1.20 | 120 | 2 | 1.20 |
| 22 | Comparative | none | I-22 | $5 \times 10^{-5}$ | none | — | Developer B | 120 | 2 | 1.25 | 120 | 2 | 1.25 |
| 23 | Comparative | Fuji Lith | VO-100 | | | | Fuji Lith Liquid Developer HS | 100 | 2 | 1.45 | 48 | 3 | 1.45 |

*Sensitivity is shown in relative value wherein the sensitivity of sample number 23 processed with the fresh solution is defined as 100.

Table 1 clearly indicates that the dot quality of Film No. 1 is greatly unsatisfactory whereas Film Nos. 2 to 9 and 11 to 18 of this invention are improved in the dot quality and nearly equal in both the dot quality and screen range to Film No. 23 wherein the lith film and the lith developer, both being on the market, are combined. Furthermore, the lith developer on the market is markedly deteriorated in the performance with a lapse of time whereas the processing solution of this invention can completely hold the performance to be obtained when it is freshly prepared.

With regard to Film Nos. 21 and 22 wherein the developing agent is contained not in the light-sensitive material but in the developer, they suffer from the disadvantage that the screen range is higher than that obtained by the combination of the lith film and lith developer on the market. In accordance with this invention, however, the screen range is not increased as in Film Nos. 21 and 22 and by use of the same contact screen as used in the combination of the lith film and the lith developer on the market, there can be obtained the screen range which is equal to that obtained by the combination.

According to this invention, the stabilization of the processing and the improvement in the photographic performance can be achieved simultaneously.

EXAMPLE 2

A film containing hydrazine sulfate in the amount of $1.0 \times 10^{-3}$ mole per mole of silver halide was produced by the same method as used for the production of Film No. 1 in Example 1. This film is designated as Film No. 24.

Film No. 24 and Film Nos. 3 and 15 produced in Example 1 were exposed and processed in the same manner as Film Nos. 1 to 10 just after the preparation thereof and after one month from the preparation thereof, and examined in the dot quality.

The evaluation of the dot quality was carried out using the same criterion as used in Example 1.

The results are shown in Table 2.

TABLE 2

| Film No. | Hydroquinone Compound | Hydroquinone Amount added (g mole Ag) | Hydrazine Compound | Hydrazine Amount added (mole/mole Ag) | Processing Solution | Stability of Light-sensitive Material: Dot Quality just after Coating | Stability of Light-sensitive Material: Dot Quality after One Month |
|---|---|---|---|---|---|---|---|
| 3 | Hydroquinone | 52.8 | I-2 | $1.0 \times 10^{-3}$ | Activator (A) | 2 | 2 |
| 15 | Hydroquinone | 52.8 | I-31 | $5.0 \times 10^{-3}$ | Activator (A) | 2 | 2 |
| 24 | Hydroquinone | 52.8 | Hydrazine Sulfate | $1.0 \times 10^{-3}$ | Activator (A) | 3 | 5 |

Table 2 clearly indicates that Film No. 24 containing hydrazine sulfate is not only unsatisfactory in the dot quality just after the production thereof but also markedly inferior in the dot quality after the lapse of one month whereas with Film Nos. 3 and 15 of this invention, the dot qualities just after the preparation thereof and after one month from the preparation thereof are equal to each other, which indicates their excellent stabilities.

In connection with the gradation, Film No. 24 was markedly reduced in the gradation after one month whereas Film Nos. 3 and 15 were subjected to no changes in the gradation even after one month.

EXAMPLE 3

By adding an aqueous solution of silver nitrate and an aqueous solution of potassium bromide at the same time over a period of 50 minutes to an aqueous solution of gelatin kept at 50° C. while maintaining the pAg at 7.9, a silver bromide emulsion with an average grain size of 0.25μ was produced. After the removal of soluble salts, sodium thiosulfate was added to the emulsion in the amount of 43 mg per mole of silver bromide and then the silver bromide emulsion was subjected to chemical aging at 60° C. for 60 minutes. This emulsion contained gelatin of 120 g per mole of silver bromide.

To the silver bromide emulsion were added hydroquinone dissolved in a 10% aqueous solution of gelatin and 5-methylbenzotriazole as an antifoggant, and furthermore a hardener, 2-hydroxy-4,6-dichloro-1,3,5-triazine sodium salt. Thereafter the resulting mixture was coated on a cellulose triacetate film so that the amount of silver is 45 mg per 100 $cm^2$ of the film. The amount of the hydroquinone coated was 22 mg (52.8 g/mole Ag) per 100 $cm^2$. This film is designated as Film No. 25.

For comparison, 13 films were produced in the same manner as in Example 25 wherein the compounds of the formula (I), Compounds I-2, I-12, I-22, I-23, I-24, I-27, I-30, I-31, I-35, I-40, I-43, I-45 and I-46 were added respectively, per mole of silver halide, in amounts of $1.0\times10^{-3}$ mole, $1.2\times10^{-3}$ mole, $5\times10^{-5}$ mole, $7.5\times10^{-5}$ mole, $5\times10^{-5}$ mole, $4\times10^{-5}$ mole, $7.5\times10^{-5}$ mole, $5.5\times10^{-5}$ mole, $6\times10^{-5}$ mole, $5\times10^{-5}$ mole, $2\times10^{-5}$ mole, $5\times10^{-5}$ mole and $8\times10^{-4}$ mole. These films are designated as Film Nos. 26, 27, 28, 29, 30, 31, 32, 33, 34, 35, 36, 37 and 38.

By use of a 150 line magenta contact screen, the films as produced above were exposed to light through an exposure wedge for sensitometry. Thereafter, they were developed at 20° C. for 10 seconds with the alkaline activators (A), ($B_1$) and ($B_2$) having the formulations as illustrated later wherein in one case the activator was stirred and in the other case it was not stirred, stopped, fixed, washed with water and dried. Then their photographic characteristics were examined.

The stirring of the activator was carried out by blowing therein a given amount (100 ml/sec.) of nitrogen during the development through fine openings provided on the side walls of a pipe which had been placed in a one liter activator bath at the bottom thereof.

Formulation of Activator

| | Activator A | Activator $B_1$ | Activator $B_2$ |
|---|---|---|---|
| Anhydrous Sodium Sulfite | 15 g | 15 g | 15 g |
| Potassium Bromide | 3.5 g | 3.5 g | 3.5 g |
| Potassium Carbonate | 10.0 g | 10.0 g | 10.0 g |
| Sodium Hydroxide | 40.0 g | 40.0 g | 40.0 g |
| Hydrazine Sulfate (III-1) | — | 2.0 g | — |
| $NH_2NHCNH_2.HCl$ (III-5) ‖ O | — | — | 2.0 g |
| Water to make | 1 liter | 1 liter | 1 liter |

The results of the dot quality are shown in Table 3. In Table 3, the dot quality was visually evaluated in five grades, in which (1) indicates the best and (5), the worst. As a dot original plate for plate-making, only (1) and (2) are practically usable, and (3), (4) and (5) are practically unsatisfactory.

From the results as illustrated in Table 3, it can be seen that the dot quality is kept constant irrespective of the stirring conditions and furthermore it is improved.

TABLE 3

| Film No. | Compound | Amount added (mole/mole Ag) | Activator (A) No Stirring | Activator (A) Stirring | Activator ($B_1$) No Stirring | Activator ($B_1$) Stirring | Activator ($B_2$) No Stirring | Activator ($B_2$) Stirring |
|---|---|---|---|---|---|---|---|---|
| 25 | — | — | 5 | 5 | 4 | 4 | 4 | 4 |
| 26 | I-2 | $1.0 \times 10^{-3}$ | 2 | 4 | 1 | 1 | 1 | 1 |
| 27 | I-12 | $1.2 \times 10^{-3}$ | 2 | 4 | 1 | 1 | 1 | 1 |

TABLE 3-continued

| Film No. | Compound | Amount added (mole/mole Ag) | Activator (A) No Stirring | Activator (A) Stirring | Activator ($B_1$) No Stirring | Activator ($B_1$) Stirring | Activator ($B_2$) No Stirring | Activator ($B_2$) Stirring |
|---|---|---|---|---|---|---|---|---|
| 28 | I-22 | $5.0 \times 10^{-5}$ | 2 | 4 | 1 | 1 | 1 | 1 |
| 29 | I-23 | $7.5 \times 10^{-5}$ | 2 | 4 | 1 | 1 | 1 | 1 |
| 30 | I-24 | $5.0 \times 10^{-5}$ | 3 | 4 | 2 | 2 | 2 | 2 |
| 31 | I-27 | $4.0 \times 10^{-5}$ | 2 | 4 | 1 | 1 | 1 | 1 |
| 32 | I-30 | $7.5 \times 10^{-5}$ | 3 | 4 | 2 | 2 | 2 | 2 |
| 33 | I-31 | $5.5 \times 10^{-5}$ | 2 | 4 | 1 | 1 | 1 | 1 |
| 34 | I-35 | $6.0 \times 10^{-5}$ | 2 | 4 | 1 | 1 | 1 | 1 |
| 35 | I-40 | $5.0 \times 10^{-5}$ | 2 | 4 | 1 | 1 | 1 | 1 |
| 36 | I-43 | $2.0 \times 10^{-5}$ | 2 | 4 | 1 | 1 | 1 | 1 |
| 37 | I-45 | $5.0 \times 10^{-5}$ | 3 | 4 | 2 | 2 | 2 | 2 |
| 38 | I-46 | $8.0 \times 10^{-4}$ | 2 | 4 | 1 | 1 | 1 | 1 |

While the invention has been described in detail and with reference to specific embodiments thereof, it will be apparent to one skilled in the art that various changes and modifications can be made therein without departing from the spirit and scope thereof.

What is claimed is:

1. A method of forming a negative dot image having a gamma value of more than 10 which comprises imagewise exposing to light through a contact screen a silver halide photographic light-sensitive material of substantially the surface latent image type which contains in a silver halide emulsion layer or another hydrophilic layer (a) a hydroquinone based developing agent, and (b) a compound represented by the formula (I) as indicated below in the amount of from about $10^{-8}$ to about $5\times10^{-2}$ mol/mol Ag and, thereafter, developing the thus exposed light-sensitive material with an activator aqueous solution having a pH of 11.5 or more $$R^1NHNHCOR^2 \qquad (I)$$

wherein $R^1$ is an aryl group which may be substituted, and $R^2$ is a hydrogen atom, an alkyl group which may be substituted, or an aryl group which may be substituted.

2. The method of claim 1 wherein $R^1$ represents a phenyl group which may be substituted.

3. The method of claim 1 or 2 wherein the aryl group represented by $R^1$ may be substituted by a member selected from the group consisting of (1) straight chain, branched chain, or cyclic alkyl groups having 1 to 20 carbon atoms, (2) mono or di-cyclic alkyl groups having 1 to 3 carbon atoms in the alkyl moiety, (3) alkoxy groups having 1 to 20 carbon atoms, (4) an amino group or an alkyl-substituted amino group, (5) an aryloxy group, (6) an acylamino group, (7) a group represented by the formula Ar—O—E—CONH, wherein Ar represents an aryl group and E represents an alkylene group, (8) a group represented by the formula $A—X—(Y)_n—$ wherein X represents a divalent connecting residue selected from $$-\overset{\overset{\displaystyle S}{\|}}{C}-\overset{\overset{\displaystyle H}{|}}{N}-,\ -S-\overset{\overset{\displaystyle S}{\|}}{C}-\overset{\overset{\displaystyle H}{|}}{N}-,\ -\overset{\overset{\displaystyle R^{11}}{|}}{N}-\overset{\overset{\displaystyle S}{\|}}{C}-\overset{\overset{\displaystyle R^{12}}{|}}{N}-$$

$$-E-\overset{\overset{\displaystyle R^{11}}{|}}{N}-\overset{\overset{\displaystyle S}{\|}}{C}-\overset{\overset{\displaystyle R^{12}}{|}}{N}-,\ -NHCO-,\ -\overset{\overset{\displaystyle R^{11}}{|}}{N}-\overset{\overset{\displaystyle O}{\|}}{C}-\overset{\overset{\displaystyle R^{12}}{|}}{N}-$$

and Y represents a divalent connecting residue selected from

—CONH—, —E—CONH—, —O—E—CONH—, —E—O—E′—CONH—, —S—E—CONH—, —$SO_2$NH—, —E—$SO_2$NH—, —E—, —E—O—E′—, —E—S—E′—, —NHCONH—, —E—NHCONH— n is 0 or 1, $R^{11}$ is a hydrogen atom, an aliphatic group, or an aromatic group; $R^{12}$ is a hydrogen atom or an aliphatic group and $R^{11}$ and $R^{12}$ may combine to complete a ring; E and E′ are divalent saturated or unsaturated aliphatic groups, and A is an alkyl group, an aryl group, an aralkyl group, or a heterocyclic ring which may be condensed with an aromatic ring; and (9) a group represented by the formula

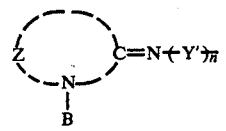

wherein Z represents the non-metallic atoms forming a 5- or 6-membered heterocyclic ring, B is a hydrogen atom or a saturated or unsaturated aliphatic group, Y′ has the same definition as Y, and n is 0 or 1; and (10) a group of the formula $R^3$ CONHNH—Ar—Y″ wherein $R^3$ has the same definition as A, Ar represents a divalent aryl group, and Y″ has the same definition as Y.

4. The method of claim 1 wherein $R^2$ represents a hydrogen atom, a methyl group, or a phenyl group, which may be substituted.

5. The method of claim 1 wherein $R^2$ represents a hydrogen atom.

6. The method of claim 1 wherein said developing agent is hydroquinone.

7. The method of claim 1 wherein said processing is carried out in the presence of a polyalkylene oxide compound.

8. The method of claim 7 wherein said polyalkylene oxide compound contains more than 10 alkylene oxide units.

9. The method of claim 7 wherein said polyalkylene oxide is present in said light-sensitive material or said activator aqueous solution.

10. The method of claim 1 wherein said activator aqueous solution additionally contains a compound of the formula (III)

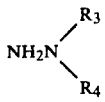

wherein $R^3$ is a hydrogen atom or a lower alkyl group, and $R^4$ is a hydrogen atom, a lower alkyl group, a lower alkenyl group, an alkoxycarbonyl group, a heterocyclic group, a carbamoyl group, a carbazoyl group, an acyl group or a phenyl group.

11. The method of claim 1, wherein the compound represented by the formula (I) is contained in an amount of from $10^{-6} \sim 10^{-3}$ mol/mol Ag.

12. The method of claim 1, wherein the hydroquinone developing agent is contained in an amount of from 0.05 to 5 mol/mol silver halide.

13. The method of claim 12, wherein the hydroquinone developing agent is contained in an amount of from 0.2 to 3 mol/mol silver halide.

14. The method of claim 10, wherein said activator contains the compound of formula (III) in an amount of from $10^{-4}$ to 1 mol per liter of the activator.

15. The method of claim 14, wherein said activator contains the compound of formula (III) in an amount of from $10^{-3}$ to $5 \times 10^{-1}$ mol per liter of the activator.

16. The method of claim 3, wherein $R_2$ represents a hydrogen atom.

* * * * *